US005704427A

United States Patent [19]

Buck et al.

[11] Patent Number: 5,704,427

[45] Date of Patent: Jan. 6, 1998

[54] PORTABLE WELL SERVICE RIG

[76] Inventors: David A. Buck, 1348 Sawmill Hwy., Breaux Bridge, La. 70517; Daniel S. Bangert, 2307 Valery Rd., New Iberia, La. 70560; Philip J. O'Connor, 112 Avery Dr., Youngsville, La. 70592

[21] Appl. No.: 542,779

[22] Filed: Oct. 13, 1995

[51] Int. Cl.[6] ..... E21B 19/06

[52] U.S. Cl. ..... 166/338; 166/377; 175/51; 175/162

[58] Field of Search ..... 166/55, 72, 297, 166/377, 361, 365, 255.1, 338, 340; 175/85, 52

[56] References Cited

U.S. PATENT DOCUMENTS

| | | | |
|---|---|---|---|
| 2,984,455 | 5/1961 | Fischer | 254/172 |
| 3,368,619 | 2/1968 | Postlewaite | 166/6 |
| 3,456,745 | 7/1969 | Peri | 175/5 |
| 3,517,737 | 6/1970 | Petersen | 166/6 |
| 3,727,685 | 4/1973 | Chestnut et al. | 166/255.1 |
| 3,857,450 | 12/1974 | Guier | 175/85 |
| 3,891,038 | 6/1975 | Delestrade et al. | 175/7 |
| 4,007,782 | 2/1977 | Nybo et al. | 166/79.1 |
| 4,125,164 | 11/1978 | Terry | 166/315 |
| 4,224,005 | 9/1980 | Dysarz | 405/196 |
| 4,305,237 | 12/1981 | Borg et al. | 52/116 |
| 4,305,467 | 12/1981 | Villines | 166/385 |
| 4,550,781 | 11/1985 | Kagler, Jr. | 166/340 |
| 5,467,833 | 11/1995 | Crain | 175/52 |
| 5,551,802 | 9/1996 | Wybro | 405/223.1 |

*Primary Examiner*—Frank Tsay
*Attorney, Agent, or Firm*—Roy, Kiesel & Tucker

[57] ABSTRACT

The present invention provides a device for removing well casing from plugged and abandoned oil wells. The invention includes a unitary platform structure sufficiently small that the structure may be transported by boat to offshore well platforms and be lifted onto the well platform as a single unit. The platform also has a center station with an opening allowing the casing to pass therethrough. The device further includes at least one lifting means, which lifts the well casing through the center station.

The present invention will serve many of the purposes of much larger drilling rigs or work over rigs typically employed on oil and gas well platforms. The present invention will be much quicker to transport and requires considerably less set-up time than dig rigs or work over rigs.

17 Claims, 3 Drawing Sheets

PORTABLE WELL SERVICE RIG

BACKGROUND OF INVENTION

In the oil and gas drilling industry, it is often necessary to plug and abandon oil and gas wells for a variety of reasons. When this is done, it is advantageous to recover as much of the well casing used in constructing the well as possible. Certain methods of retrieving the well casing from offshore wells has been described in prior patents. U.S. Pat. No. 3,983,936 to Kennard discloses cutting the casing just below the wellhead by a means attached to the drill string, gripping the casing with the means that is attached to the drill string and raising the casing in conjunction with raising the drill string. However, the Kennard device requires the use of a drilling rig or similar drilling structure to raise and lower the cutting tool. Typically, by the time the decision has been made to cap a well, the drilling rig has long since been removed from the platform and employed elsewhere. Reconstructing a drilling rig on the platform would be excessively time consuming and expensive. In the present state of the art, the typical method for removing the casing requires the use of large, cumbersome structures such as drilling rigs, work-over rigs or derrick barges. The conventional drilling rig comprises a derrick, draw works, pressure control equipment, a mud pump system, a rotary table, and a power source. Many of these components must be further broken down for transportation to the offshore platform. Upon reaching the platform, the reassembling of these components will require several days.

Workover rigs are somewhat more efficient in that they are transported to the offshore platform in modular components. However, workover rigs still require that the modules be individually lifted onto the platform and then assembled. This process may take three to four days to complete.

A derrick barge, as the name implies, is a barge with a drilling structure constructed thereon. While this eliminates the need to assemble and disassemble the drilling structure, the barge itself is a large, cumbersome and costly structure. Additionally, a second vessel is required to tow the barge to the well site. If the barge is located a considerable distance from the well to be worked on, the towing process may take a significant amount of time.

What is needed in the art is a self-contained well service rig comprising a unitary body that is small enough be placed on a work boat, barge, or similar vessels and is small enough to be hoisted onto the platform by conventional cranes typically used on well platforms. The well service rig should also be compact enough to be easily transported on public roadways on conventional truck trailers.

Since the well service rig may be lifted onto the platform as a single unit, it can be put into operation on the platform in a matter of hours as opposed to the several days required to assemble drilling rigs or workover rigs. Additionally, by being transportable on public roadways, the well service rig may be moved from one coastal location to another far more quickly than a derrick barge. Those skilled in the art will also understand the substantial cost savings in building and employing the well service rig as opposed to conventional drilling rigs, workover rigs, and derrick barges.

SUMMARY OF THE INVENTION

The present invention is a portable device that will serve many of the purposes of much larger drilling rigs or work over rigs typically employed on oil and gas well platforms.

It is an object of this invention to provide an improved device for extracting well casing that will operate more efficiently and economically than prior art devices.

It is another object of the invention to provide a portable, self-contained device for removing well casing that does not require the use of a drilling derrick or other cumbersome drilling structures.

Accordingly, the device for removing well casing includes a unitary platform structure sufficiently small that the structure may be transported by boat to offshore well platforms and be lifted onto the well platform as a single unit. The platform also has a center station with an opening allowing the casing to pass therethrough. The device further includes at least one lifting means, which lifts the well casing through the center station.

DETAILED DESCRIPTION OF INVENTION

Figure 1:
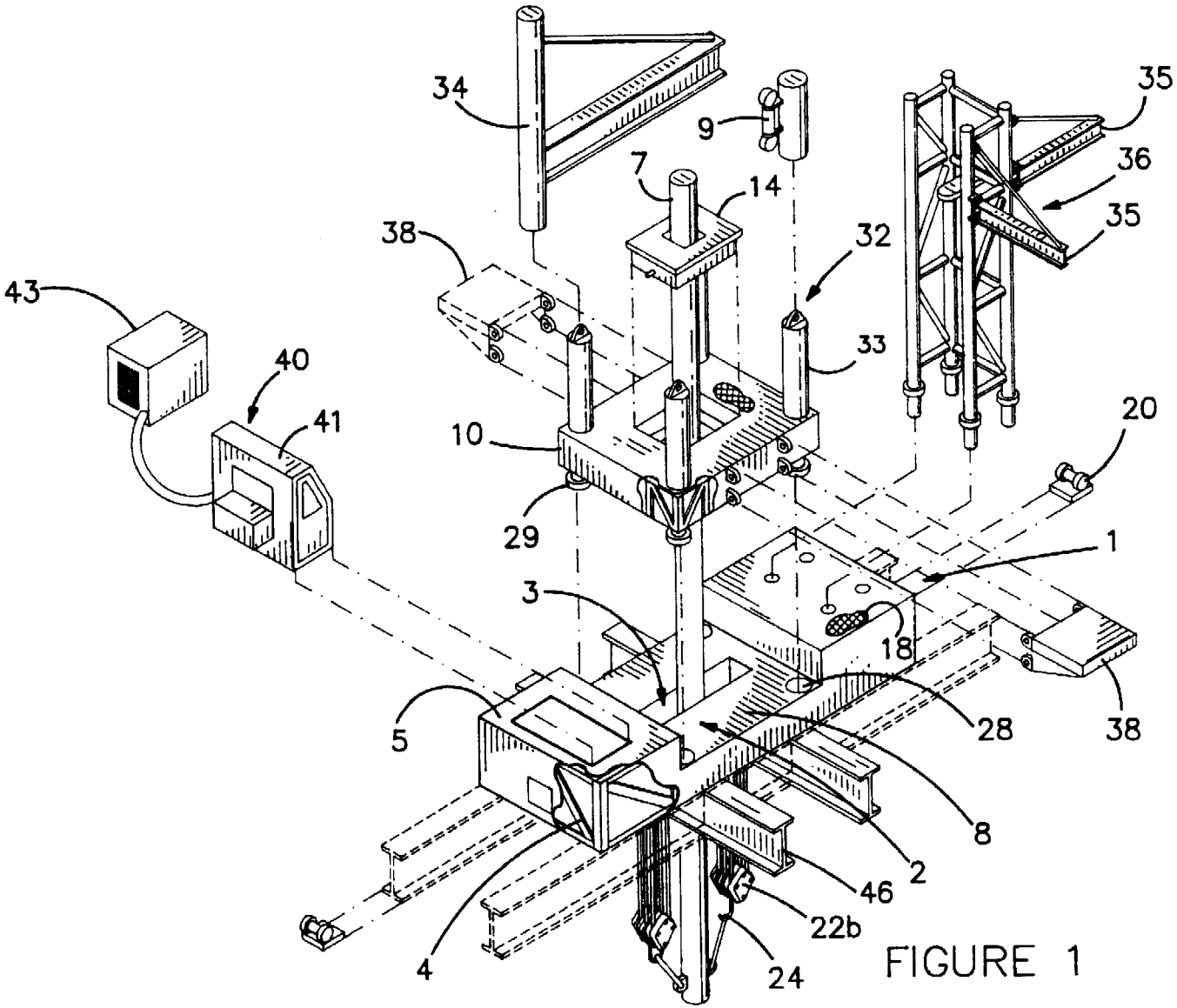
FIG. 1 is a perspective view of the well service rig with its various components.
Figure 2:
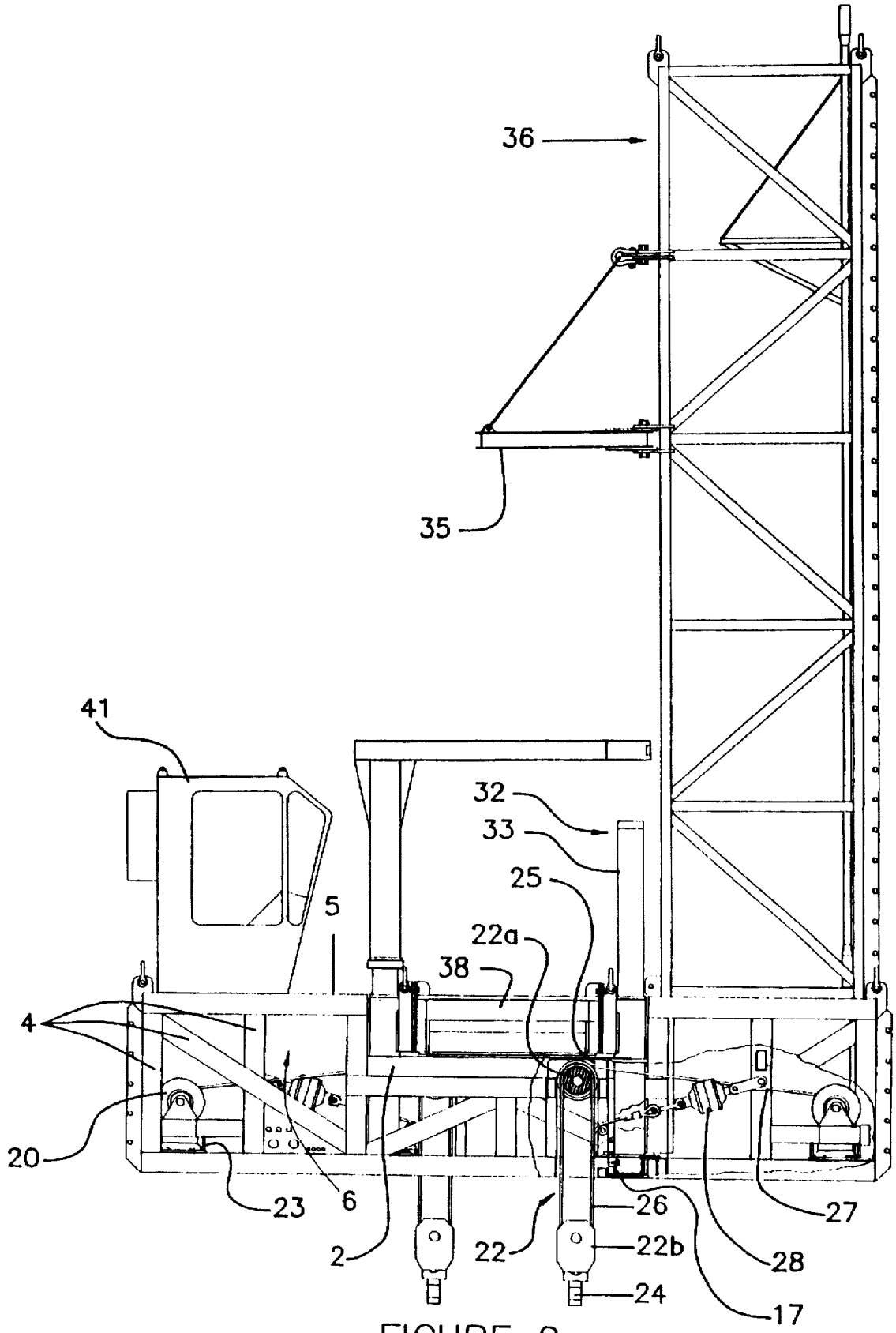
FIG. 2 is a side view of the well service rig illustrating the contents of the inner equipment housing. This figure also illustrates a partial cutaway view on the right side of the figure.

The invention will generally comprise a work platform, a center station and at least one lifting means. In a preferred embodiment shown in FIG. 1, the work platform 1 comprises a structure approximately 25 feet long, 8 feet wide, and 6 feet in height. While an 8 foot wide work platform 1 is well accommodated to transportation on public roadways, the work platform 1 can be of any size which can readily be transported to offshore oil platforms and lifted thereon by cranes or other lifting devices. The work platform I further comprises a flamed structure 4 forming a floor 5. Floor 5 may consist of any material that will support men on work platform 1, such as grating as indicated by 18. Work platform 1 will also have an inner equipment housing 6 within framed structure 4 as best seen in FIG. 2. While many materials may be used in constructing frame structure 4, metal tubing, rectangular, square or other shapes is preferred because it offers both strength and minimum weight. Returning to FIG. 1, the center station 2 is constructed to form a vertical opening 3 extending through the work platform 1, such that well casing 7 may pass freely therethrough. Generally, center station 2 can be any area centrally located on platform 1 with opening 3 extending therethrough. However, the present invention is intended to include embodiments where the center station 2 could be located at either end of platform 1. While the size of opening 3 may vary, opening 3 must be at least large enough to allow well casing 7 to pass freely therethrough. The term "casing" as used herein is intended to include all types of drill pipe, conduit, or other members, tubular or otherwise, used in petroleum wells. In the embodiment shown in FIG. 1, the center station 2 has a recessed area 8 surrounding opening 3. A self elevating floor 10 will be positioned inside of recessed area 8 and will be described in greater detail below. It is sufficient for now to understand from viewing FIG. 1 that opening 3 extends through work platform 1, self elevating floor 10, and rotary table 14 (also explained below) such that well casing 7 can freely pass through all of these structures.

In a preferred embodiment shown in FIG. 2, the inner equipment housing 6 has sufficient space to accommodate a lifting means comprising hydraulic winches 20 and block and tackle type assemblies depicted as sheave assemblies 22 as shown in the cutaway section on the right side of FIG. 2. This embodiment also envisions inner equipment housing 6 having a lower floor 23 which is large enough to support the winches 20 and which will be situated toward the outer ends of the work platform 1. Sheave assemblies 22 comprise an upper sheave 22*a* and a lower sheave 22*b* with a cable 26 looped between the upper and lower sheaves. Upper sheave 22*a* will be supported by brackets 25. Two brackets 25 are positioned beneath the platform floor 5, on opposite sides of the center station 2. Lower sheave 22*b* will typically have an attaching means 24 connect to it for securing lower sheave 22*b* to the well casing 7, as will be explained below.

One end of a cable 26 will be attached to winch 20 and the opposite end, after being reeved through the sheave assembly 22, will be tied off on a deadmen 27. In the embodiment shown in FIG. 2, load cell 28 is interposed between cable 26 and deadmen 27. Load cell 28 will measure the tension in cable 26 and transmit this information to the operator's station. Deadmen 27 normally will be located in the upper part of the inner equipment housing 6, between sheave assemblies 22 and winches 20, but may be in any convenient location.

The combination of winches 20 and sheave assemblies 22 comprises the primary lifting apparatus. A preferred embodiment of the invention envisions two winch/sheave assembly combinations located on opposing sides of the center station 2 as shown in FIG. 2. The sheave assemblies 22 will generally apply a varying degrees of mechanical advantage depending on the number of pulley members used in sheave assemblies 22. The sheave assemblies 22 allow the lifting capacity of winches 22 to be multiplied while permitting winches 20 to be small enough to be positioned inside equipment housing 6. Of course, those skilled in the art will recognize that the size of winches 20 and sheave assemblies 22 can be varied.

The winches 20 will typically be capable of lifting the casing through a distance of 40 feet. However, greater lengths of cable 26 may be employed where necessary for particular applications. Additionally, while a preferred embodiment of the invention encompasses positioning the winches 20 in the inner equipment housing 6 of the work platform 1, as described above, the winches 20 could be either be mounted on the upper floor of the work platform 1 or below equipment housing 6. The arrangement depicted in FIG. 2 is preferred because it provides addition room for workmen on the upper floor 5 and at the center station 2 and provides a generally safer work area. Furthermore, while the primary lifting device has been described a winch and sheave assembly combination, those skilled in the art will understand many alternate lifting methods could be employed as the primary lifting means.

In addition to the primary lifting device, the embodiment shown in the figures comprises a secondary lifting device. Returning to FIG. 1, the secondary lifting device comprises a plurality of linear actuators 32 mounted to elevating floor 10. Linear actuators 32 could be comprised of power screws, rack and pinion gear systems, or as shown in FIG. 1, hydraulic cylinders 33. In operation, hydraulic cylinders 33 will extend cylinder rams 29 (the bottoms of which are seen in FIG. 1) in order to raise elevating floor 10 above floor 5. While hydraulic cylinders 33 are shown mounted on the four corners of elevating floor 10 such that cylinder rams 29 will engage receiving apertures 28, hydraulic cylinders 33 could be mounted in any arrangement as long as they could function to lift elevating floor 10. As best seen in FIG. 2, a preferred embodiment shows cylinder rams 29 extending through receiving apertures 28 and resting on reinforcing plates 17. Reinforcing plates 17 are designed to distribute the load on cylinder rams 29 to the frame members of platform 1. When cylinder rams 29 are in the retracted position, elevating floor 10 rests in recessed area 8 as shown in FIG. 2. As explained above, center opening 21 also communicates with elevating floor 10 to insure the existence of a continuous passage through working platform 1.

Also as seen in FIG. 1, a conventional powered rotary table 14 may be positioned in elevating floor 10. Center opening 3 through rotary table 14 is sized to accommodate a variety of drilling tools such, slips and bowls, plates, and other tools. Rotary table 14 will allow the employment of rotating oil field tools, such as devices for cutting casing 7. Further, rotary table 14 can supply rotational motion that may help free casing 7 from the sides of the well hole. Finally, while a power tong tool is typically used to break or unscrew well casing, in the absence of such a tool the rotary table 14 can be used for this purpose.

Other features of the invention are also shown in FIG. 1. Jib crane 34 may be position on hydraulic cylinders 33. While jib crane 34 may be fixed on hydraulic cylinders 33 in number of ways, the present embodiment shows jib crane 34 slidingly engaging hydraulic cylinder 33. Jib crane 34 will greatly facilitate the movement of the heavy equipment employed in the casing extraction proceeds. If useful to the particular operation, additional jib cranes 34 could be positioned on the other hydraulic cylinders 33. The present invention can also utilize lifting devices other than jib cranes 34. For example, "EZ Torque Cylinders" 9, such as those produced by Drill Co., Inc. of Houstort, Tex. could be used in place of or in combination with jib cranes 34.

A small derrick tower 36 may be positioned to one side of work platform 1 for the efficient stacking of tubing, drill pipe, casing sections or other members removed from the well. Tower 36 may also be equipped with jib cranes 35, which may be used in place of or in conjunction with jib cranes 34. While the exact structure of tower 36 may appear somewhat different in FIGS. 1 and 2, those skilled in the art will recognize many variations of tower 36 may be employed in the present invention.

Viewing FIG. 1, tong platforms 38 are removably positioned on the side of elevating floor 10 to provide additional space to workers who may be using power tong gripping tools to break casing sections as the casing is extracted from the well. While FIG. 1 shows tong platforms 38 exploded from elevating floor 10, the side view of FIG. 2 illustrates the tong platforms 38 attached to elevating floor 10. In addition to being removable from elevating floor 10, tong platforms 38 are pivotally attached to elevating floor 10. In this manner, during transportation tong platforms 38 can be folded onto elevating floor 10 rather than completely removed.

An operator's control station 40 will be position on the side of work platform 1 opposite derrick tower 36. In the embodiment shown, control station 40 is an enclosed cabin 41 protecting the operator from excessive noise and adverse weather conditions. As with tower 38, FIGS. 1 and 2 show somewhat different enclosed cabins 41. It is understood that many variations of enclosed cabin 41 could be used with the present invention.

From cabin 41, the operator will be able to operate the numerous devices employed on the well service rig. A power pack 43 will contain a means for powering (typically a diesel motor) the hydraulic pumps necessary for operating the various hydraulic components of the well service rig. However, power pack 43 will not typically be mounted on work platform 1, but rather will be positioned at any convenient location in the vicinity of platform 1.

The foregoing description illustrates a well service rig comprising a unitary working platform. The working platform 1 is unitary in that all the components of the well service rig are positioned on or in work platform 1. The invention may be transported, positioned on the offshore platform, and operated as a single unit. It is not necessary to break the invention into numerous components as must be done with conventional drilling rigs and workover rigs.

OPERATION OF INVENTION

Figure 3:
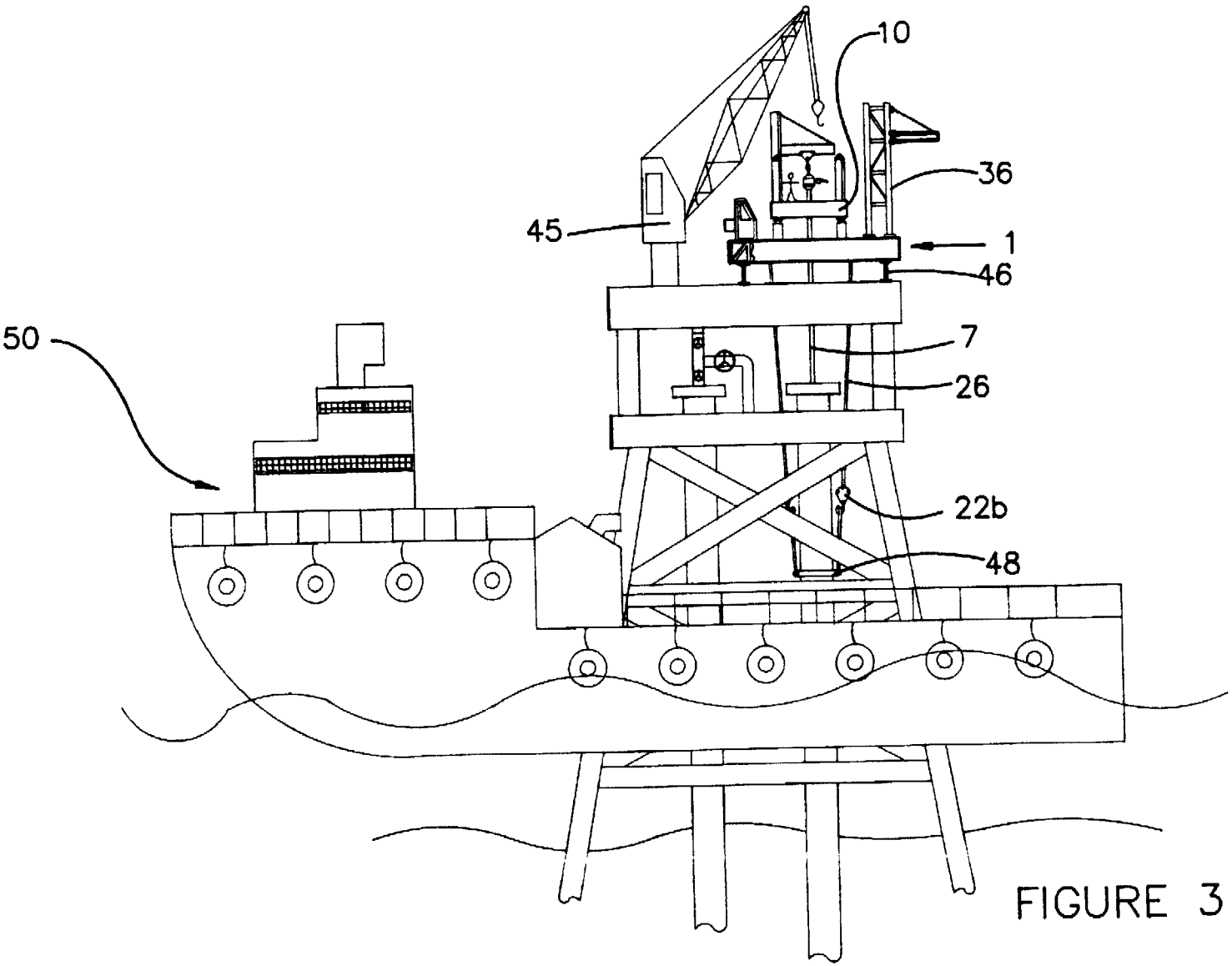
FIG. 3 is a side view of the invention positioned on an offshore platform and a transporting vessel position in the foreground.

In practice, the invention will be transported to the offshore oil platform on a boat 50 or other vessel as shown in FIG. 3. The invention will be lifted onto the drilling platform with a crane 45 or similar available lifting means. The work platform 1 is then positioned on the well platform so that center opening 3 running through the center station 2 is aligned with the casing 7 in the well. FIGS. 1 and 3 illustrate the work platform 1 being positioned on a base formed of work beams 46 since the decking of offshore platforms may not be strong enough to support the well service rig in operation. Work beams 46 will typically be large I-beams of sufficient length to span the distance between the offshore platform's structural members.

Gripping device 48 is positioned to the lowest convenient point on the casing 7. Gripping device 48 may be removable gripping tools, such as elevators or fixed gripping tools such as pad-eyes welded to the casing 7. Cable 26 will be played out allowing lower sheave **22*b* to extend to the point where it can be attached to gripping device 48. Gripping device 48 will then be hooked, bolted or otherwise connected to the lower sheaves 22*b* with attachment means 24 (as shown in FIG. 1). As winches 20 are activated, the sheave assemblies 22 exert an upward force on the gripping device 48 and correspondingly on the casing 7. The casing 7 is pulled upward through center opening 3 in the work platform 1. When a sufficient length of casing 7 has been drawn through the center opening 3 and extends above floor 5 of work platform 1, the casing 7 may be secured in the rotary table 14 by slips or another conventional tool. The section of casing 7 extending above rotary table 14 will typically be attached to an independent lifting means such as crane 45. Casing 7 will then be cut or broken at a point above rotary table 14. The freed casing section suspended from crane 45 will then be positioned securely against derrick tower 36 or off loaded onto the boat 50**.

It will be appreciated that the present invention provides a lifting arrangement differing from conventional drilling rigs and workover rigs. In the prior art, the lifting device is positioned on some form of derrick above the slips which secures casing 7 in the rotary table. In the present invention, the lifting device is positioned beneath the slips in the rotary table, thereby eliminating the need for the cumbersome prior art derricks.

The present invention also provides flexibility in operation in that two alternate methods of lifting casing 7 may be employed in addition to the method described above. First, while the casing 7 is secured in the rotary table 14 by slips, the elevating floor 10 will be raised to lift the casing 7. The casing 7 is then gripped below work platform 1 by elevators and the elevators attached to cable 26. Cable 26 will hold the casing in position allowing the elevating floor 10 to be lowered for another lift. Secondly, the crane 45 located on the offshore platform may be used to lift casing 7 with casing 7 be secured in the slips at rotary table 14 after crane 45 has completed the lift. Casing 7 can then be cut above the slips or a second lift can be carded out on easing 7 by crane 45. Those skilled in the art will appreciate the advantages the versatile nature of the present invention provides over the prior art.

In the unusual situation in which neither the primary lifting device nor the secondary lifting device may by themselves lift the casing 7, both lifting devices could be simultaneously attached to casing 7. This would allow maximum lifting forces to be applied to casing 7.

The foregoing disclosure and description of the invention are only illustrative and explanatory thereof, and various changes in the size, shape and materials as well as in the details of the illustrated construction may be made without departing from the spirit of the invention.

I claim:

1. A self-contained well service rig comprising:

(a) a unitary, crane liftable working platform;

(b) a center station integral with said working platform, said center station having a center opening therein; and (c) a primary lifting device and a secondary lifting device attached to said working platform, wherein said primary and secondary lifting device are controlled by a central control station.

2. A well service rig as in claim 1, wherein said central control station is positioned on said working platform.

3. A well service rig as in claim 1, wherein said working platform is not substantially larger than necessary to accommodate an elevating floor with a rotary table, a control station and a derrick tower for stacking tubular members.

4. A well service rig as in claim 1, wherein said primary lifting device comprises at least one winch positioned in an inner equipment housing.

5. A well service rig as in claim 4, wherein said primary lifting device has two opposed winches and each of said winches are operably connected to a sheave assembly.

6. A well service rig as in claim 1, wherein said secondary lifting device is positioned adjacent to said center station.

7. A well service rig as in claim 1, wherein said secondary lifting device comprises a plurality of linear actuators.

8. A well service rig as in claim 1, wherein an elevating floor is connected said secondary lifting device.

9. A well service rig as in claim 8, wherein said center station has a recessed area surrounding said elevating floor, said secondary lifting device is positioned in said recessed area, and said elevating floor is sized to fit within said recessed area.

10. A well service rig as in claim 8 wherein a rotary table is positioned in said elevating floor.

11. A well service rig as in claim 10 wherein said rotary table has a center opening formed therethrough which is capable of accommodating oil field tools.

12. A process for extracting well casing with a movable platform having a first and second lifting device contained thereon and said second lifting device having a rotary means attached thereto, said process comprising the steps of:

(a) attaching said first lifting device to a first point on a tubular member;

(b) applying an upward force to said tubular member with with said first lifting device;

(c) attaching a cutting device to said rotary means and positioning said cutting device within said tubular member below said first point;

(d) cutting said tubular member below said first point.

13. A self-contained well service rig comprising:

(a) a unitary, crane liftable working platform;

(b) a center station integral with said working platform, said center station having a center opening therein; and (c) a lifting device comprising a linear actuator, said linear actuator being positioned adjacent to said center station such that said linear actuator may impart an upward force to a tubular member positioned to extend through said center station.

14. A well service rig as in claim 13, wherein said lifting device comprises a plurality of linear actuators.

15. A well service rig as in claim 14, wherein one or said plurality of linear actuators is position on at least two sides of said center station.

16. A well service rig as in claims 10, wherein an elevating floor is connected to said linear actuator.

17. A well service rig as in claim 16, wherein a rotary table is positioned in said elevating floor.

* * * * *